United States Patent [19]

Jackson

[11] 4,201,143

[45] May 6, 1980

[54] CAM DRIVEN SLIDING NEEDLE BAR

[75] Inventor: Stanley P. Jackson, Shipley, England

[73] Assignee: Firth Carpets Limited, Brighouse, England

[21] Appl. No.: 925,152

[22] Filed: Jul. 17, 1978

[30] Foreign Application Priority Data

Jul. 18, 1977 [FR] France ..... 77 22995
Jun. 20, 1978 [FR] France ..... 78 19400

[51] Int. Cl.[2] ..... D05C 15/00
[52] U.S. Cl. ..... 112/79 R
[58] Field of Search ..... 112/79 R, 121.11; 66/207; 74/567, 55, 27

[56] References Cited

U.S. PATENT DOCUMENTS

| | | | |
|---|---|---|---|
| 658,825 | 10/1900 | Bean | 74/55 |
| 2,429,659 | 10/1947 | Zellweger et al. | 200/28 |
| 3,109,395 | 11/1963 | Batty et al. | 112/79 R |
| 3,213,813 | 10/1965 | Chambers | 112/79 R |
| 3,577,943 | 5/1971 | Watkins | 112/79 R |
| 3,600,758 | 8/1971 | Vonkaenel et al. | 14/225 |
| 3,864,981 | 2/1975 | Schlegel | 112/79 R |
| 3,964,407 | 6/1976 | Ingram et al. | 112/79 R |

FOREIGN PATENT DOCUMENTS

| | | | |
|---|---|---|---|
| 259027 | 10/1926 | United Kingdom | 66/207 |

*Primary Examiner*—Ronald Feldbaum
*Attorney, Agent, or Firm*—Diller, Ramik & Wight

[57] ABSTRACT

In a sliding needle bar tufting machine in which displacement of a needle bar transversely of a tufted fabric undergoing manufacture to create a pattern in the fabric is effected by the action of rotary cam means on a needle bar carrier member, the invention provides single or single-acting cam follower means on the needle bar carrier member and a pair or appropriately spaced rotary cams of conjugate shape acting on said cam follower means. The use of two cams of conjugate shape makes it unnecessary for the individual cams to be symmetrical about their centers of rotation and thereby enables the production in the fabric of patterns which are asymmetrical in character.

5 Claims, 4 Drawing Figures

CAM DRIVEN SLIDING NEEDLE BAR

This invention concerns tufting machines and relates more particularly to so-called sliding needle bar tufting machines by means of which, during manufacture, a pattern is incorporated in a tufted textile fabric such as a carpet fabric.

Displacement of a sliding needle bar transversely of a tufted fabric undergoing manufacture is usually accomplished by means of a rotary cam mounted adjacent a sliding carrier member from which the needle bar extends, the carrier member having a pair of spaced cam followers arranged to engage diametrically opposed portions of the cam. Whilst this arrangement is perfectly satisfactory in operation, it does have the limitation that the use of two cam followers necessitates a symmetrical cam and that this in turn produces movements of the sliding needle bar which are symmetrical about its datum. Such a machine is therefore restricted to the manufacture of fabrics having patterns which are of a similarly symmetrical or mirror-image nature.

According to the present invention, this limitation is avoided by providing the sliding carrier member with single or single-acting cam follower means which are acted upon by a pair of appropriately spaced cams of conjugate shape.

In the case of a single cam follower, the cams may conveniently act against opposed regions thereof and the engagement of the single cam follower between a pair of cams ensures positive mechanical location of the sliding carrier member and accuracy in displacement of the needle bar. At the same time, the provision of two cams of conjugate shape removes the necessity for the individual cams to be symmetrical about their centres of rotation. Such a construction, however, requires the cams and cam follower to be arranged in more or less linear relation with one another, which can be uneconomical in space requirements. In a modification of the invention, therefore, the conjugate cams are mounted on a common drive shaft and each cam co-operates with an associated cam follower which is single-acting in the sense that it is displaceable by its cam only in a single direction.

The invention will be described further, by way of example, with reference to the accompanying drawings, in which.

Figure 2:
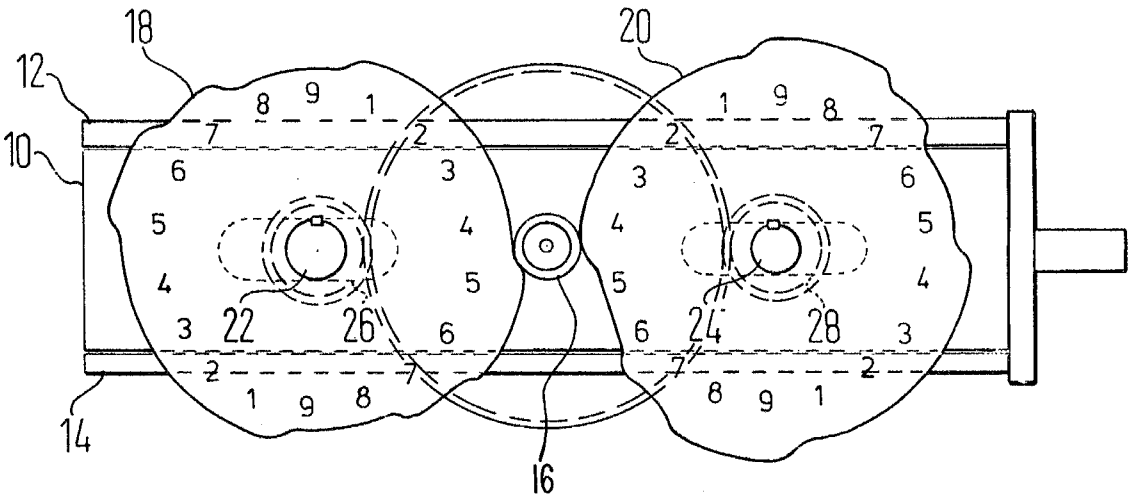
FIG. 2 is a front view thereof.
Figure 1:
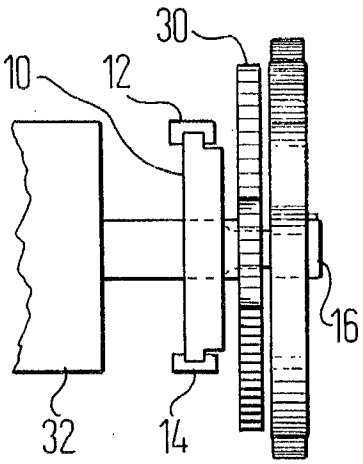
FIG. 1 is a side elevation of a sliding needle bar carrier and cam assembly embodying the invention.

As shown in FIGS. 1 and 2 of the drawings, a sliding needle bar carrier 10 is mounted for movement within top and bottom guides 12,14 and has secured to it, a centrally situated cam follower 16.

Conjugate cams 18,20 mounted respectively on drive shafts 22,24 engage diametrically opposed regions of the cam follower 16, the drive shafts 22 and 24 passing through respective slots 26 and 28 formed in the carrier member 10 and being provided on the opposite side of the carrier member 10 with drive pinions (not shown) which are driven by a spur gear 30. The spur gear 30 in turn is driven from a gear box 32 powered in any convenient conventional manner, as by an electric motor.

As the cams 18 and 20 are rotated, their conjugate surfaces displace the cam follower to effect longitudinal displacement of the carrier member 10 in its guides 12 and 14 and thereby to effect displacement of the needle bar (not shown) which is connected to the right hand end of the carrier 10 as viewed in the drawings. By virtue of this displacement, the yarns carried by the needles (not shown) mounted in the needle bar are displaced to cause a pattern to be executed in the fabric being manufactured and it will be appreciated that symmetry in that pattern is not required since it is similarly not required in the cams themselves.

In all other respects, the construction and operation of a sliding needle bar tufting machine in accordance with the invention may be conventional and requires no further description herein.

Figure 3:
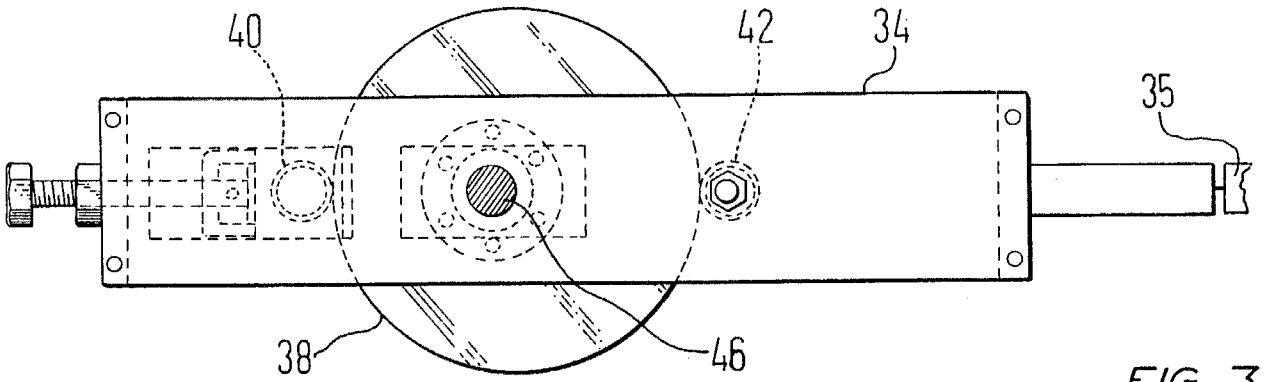
FIG. 3 is a side elevation of another embodiment of the invention.
Figure 4:
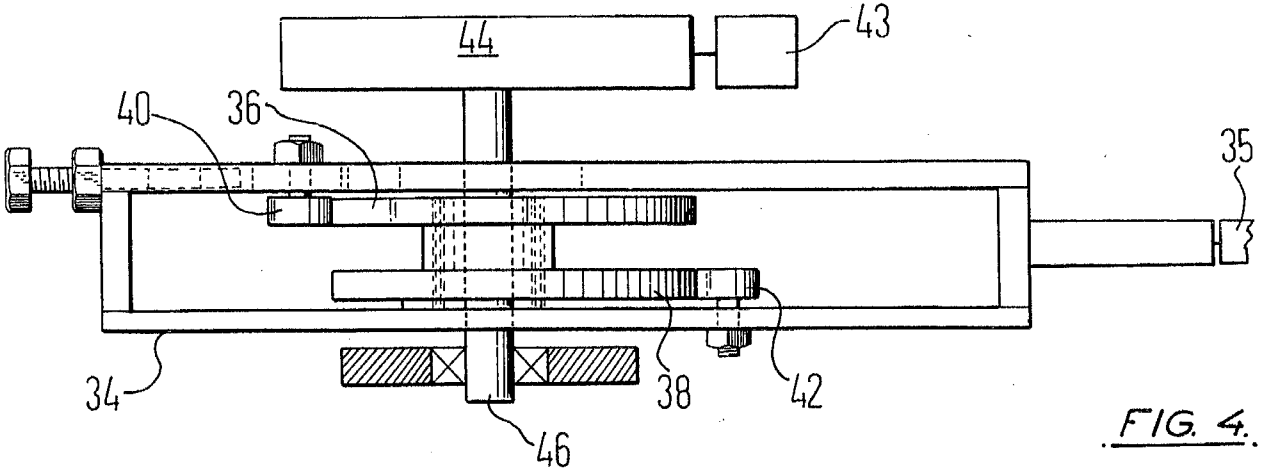
FIG. 4 is a plan view thereof.

Referring now to FIGS. 3 and 4, a sliding needle bar carrier 34 has rigidly secured to it, a pair of laterally spaced cam followers 40 and 42 which co-operate respectively with conjugate cams 36 and 38 mounted on an output shaft 46 of a gear box 44. Power input to the gear box 44 is provided in any convenient conventional way and by way of example is shown in the drawings as being from an electric motor diagrammatically indicated at 43. As will be evident from simple inspection of the drawings, each cam follower 40,42 is single acting, in the sense that it is effective or responsive to rotation of its associated cam 36, 38, respectively, to displace the needle bar carrier 34 and needle bar 35 in one direction only. By mounting the cams 36 and 38 on the common drive shaft 46, however, they may be accommodated in rather less space than is required by the arrangement of FIGS. 1 and 2.

I claim:

1. A tufting machine comprising a needle bar, an apertured, elongate needle bar carrier member connected to said needle bar, guide means mounting said needle bar carrier member for longitudinal movement therein, a pair of longitudinally spaced cams of conjugate shape situated at one side of said needle bar carrier member, cam drive means situated on the other side of said carrier member and including respective drive shafts for mounting said cams, said drive shafts passing through the apertures in the needle bar carrier member, and a centrally situated cam follower member secured directly to and carried by said needle bar carrier member between said cams and having diametrically opposed regions engaged directly by said cams, and said needle bar carrier member being displaceable in response to rotation of said cams by said drive shafts to effect said longitudinal movement of said needle bar carrier member in said guide means.

2. A tufting machine as set forth in claim 1, wherein said drive means includes a pinion on each of said drive shafts, a spur gear engaging said pinnions and a driven gear box transmitting rotary motion to said spur gear.

3. A tufting machine comprising a needle bar, a sliding needle bar carrier member connected to said needle bar, cam follower means mounted directly on and carried by said needle bar carrier member, a pair of driven rotary cams of conjugate shape each acting directly upon said cam follower means to effect longitudinal sliding displacement of said needle bar carrier member and hence of said needle bar, said cam follower means having diametrically opposite regions engaged directly by said cams, and said needle bar carrier member being displaceable in response to rotation of said cams to effect said longitudinal sliding displacement of said needle bar carrier member.

4. The tufting machine as defined in claim 3 wherein said needle bar carrier member includes elongated slot means for receiving therethrough shaft means for imparting rotation to said rotary means.

5. The tufting machine as defined in claim 4 wherein said cam follower means is a single cam follower.

* * * * *